US008479453B1

(12) United States Patent
Francis

(10) Patent No.: US 8,479,453 B1
(45) Date of Patent: Jul. 9, 2013

(54) STAGE FRAME ASSEMBLY

(75) Inventor: Einstein B. Francis, Archbold, OH (US)

(73) Assignee: biljax, inc., Archbold, OH (US)

( * ) Notice: Subject to any disclaimer, the term of this patent is extended or adjusted under 35 U.S.C. 154(b) by 506 days.

(21) Appl. No.: 12/583,989

(22) Filed: Aug. 28, 2009

Related U.S. Application Data

(60) Provisional application No. 61/192,170, filed on Sep. 16, 2008.

(51) Int. Cl.
*E04H 3/10* (2006.01)

(52) U.S. Cl.
USPC ..... 52/6; 52/7; 52/506.04; 182/222

(58) Field of Classification Search
USPC ..... 52/6, 7, 127.7, 506.04, 506.06, 562, 52/263, 8, 474; 182/222; 108/157.16, 157.17, 108/157.18, 159, 158.12
See application file for complete search history.

(56) References Cited

U.S. PATENT DOCUMENTS 4,416,097 A * 11/1983 Weir ..... 52/220.2
4,449,346 A * 5/1984 Tremblay ..... 52/509
4,656,795 A * 4/1987 Albrecht et al. ..... 52/126.6
4,759,162 A 7/1988 Wyse
4,942,708 A * 7/1990 Krumholz et al. ..... 52/263
4,982,538 A * 1/1991 Horstketter ..... 52/259
5,205,087 A * 4/1993 Jines ..... 52/6
5,319,906 A * 6/1994 Hayden ..... 52/127.6
5,323,563 A 6/1994 Rogers et al.
5,613,450 A 3/1997 Wagner et al.
5,660,121 A * 8/1997 Botts et al. ..... 108/132
5,848,501 A 12/1998 Taipale et al.
5,927,027 A * 7/1999 Richardson ..... 52/200
5,930,966 A * 8/1999 Wood et al. ..... 52/364
6,024,026 A 2/2000 Botts et al.
6,070,367 A 6/2000 Wagner et al.
6,164,016 A 12/2000 Bue et al.
7,546,707 B1 * 6/2009 DiGennaro ..... 52/177
7,624,540 B1 * 12/2009 Hayden et al. ..... 52/6
2004/0211137 A1 * 10/2004 Thiede ..... 52/272
2006/0027727 A1 * 2/2006 Gillespie et al. ..... 249/18

OTHER PUBLICATIONS

U.S. 5,323,564, (withdrawn).

* cited by examiner

*Primary Examiner* — Branon Painter
(74) *Attorney, Agent, or Firm* — Emch, Schaffer, Schaub & Porcello Co., LPA

(57) ABSTRACT

This stage frame assembly includes a horizontal frame member configured to join and support adjacent, horizontal frame members. The performance stage frame member has a shaped cross-section wherein the frame member includes a top lip and a chamfer extending from the top lip. A plurality of frame members capture and support a stage deck wherein the stage deck is flush with the top lip.

7 Claims, 9 Drawing Sheets

STAGE FRAME ASSEMBLY

CROSS REFERENCE TO RELATED APPLICATION

This application claims the benefit of U.S. Provisional Application Ser. No. 61/192,170, filed Sep. 16, 2008.

TECHNICAL FIELD

This invention relates to a performance stage frame member. More specifically, the present invention relates to a performance stage deck for theatrical or musical events.

BACKGROUND OF THE INVENTION

A substantial need exists for performance stage deck assemblies which can be relatively quickly assembled and dismantled for temporary use but which also have strength and durability for longer term use. A modular platform assembly includes rectangular, preferably squared deck sections which can be employed in virtually any number to provide platforms or stages of any desired shape and area. Each of the deck sections has a rectangular metal frame to which is affixed wooden sheeting or the like. Contiguous sides of the frame have interlocking means by which adjacent sections can be readily connected, with the sheeting forming a smooth unbroken stage or deck surface.

While the current design of the staging provides satisfactory results, there is a demand for improvement, specifically with flat top surfaces with horizontal alignment.

SUMMARY OF THE INVENTION

The performance stage assembly of the present invention includes a combination of deck sections integrally joined together, creating a platform of desired size and shape. Each deck section includes a deck panel supported by a frame. The frames are constructed from unique horizontal frame members having a shaped cross-section wherein the frame member includes a top lip and a chamfer extending from the top lip. Preferably, the chamfer is a beveled edge angularly extending inwardly and downwardly from the top lip. Typically, the top lip and chamfer form a 45° angle. The frame member also comprises a vertically extending back surface with the top lip extending inwardly and horizontally from the back surface. The frame member further comprises a bottom lip extending inwardly and horizontally from the back surface.

A performance stage deck according to this invention comprises a stage deck and a plurality of frame members wherein the plurality of frame members capture and support the stage deck. The stage deck is flush with the top lip. Preferably, the stage deck has a flat top surface. The plurality of frame members also has a flat top surface. As a result, the flat surfaces are in a horizontal alignment with each other. No fasteners are required to connect the stage deck to the frame members.

Other objects and advantages of the present invention will become apparent to those skilled in the art upon a review of the following detailed description of the preferred embodiments and the accompanying drawings.

DETAILED DESCRIPTION OF THE INVENTION

Figure 1:
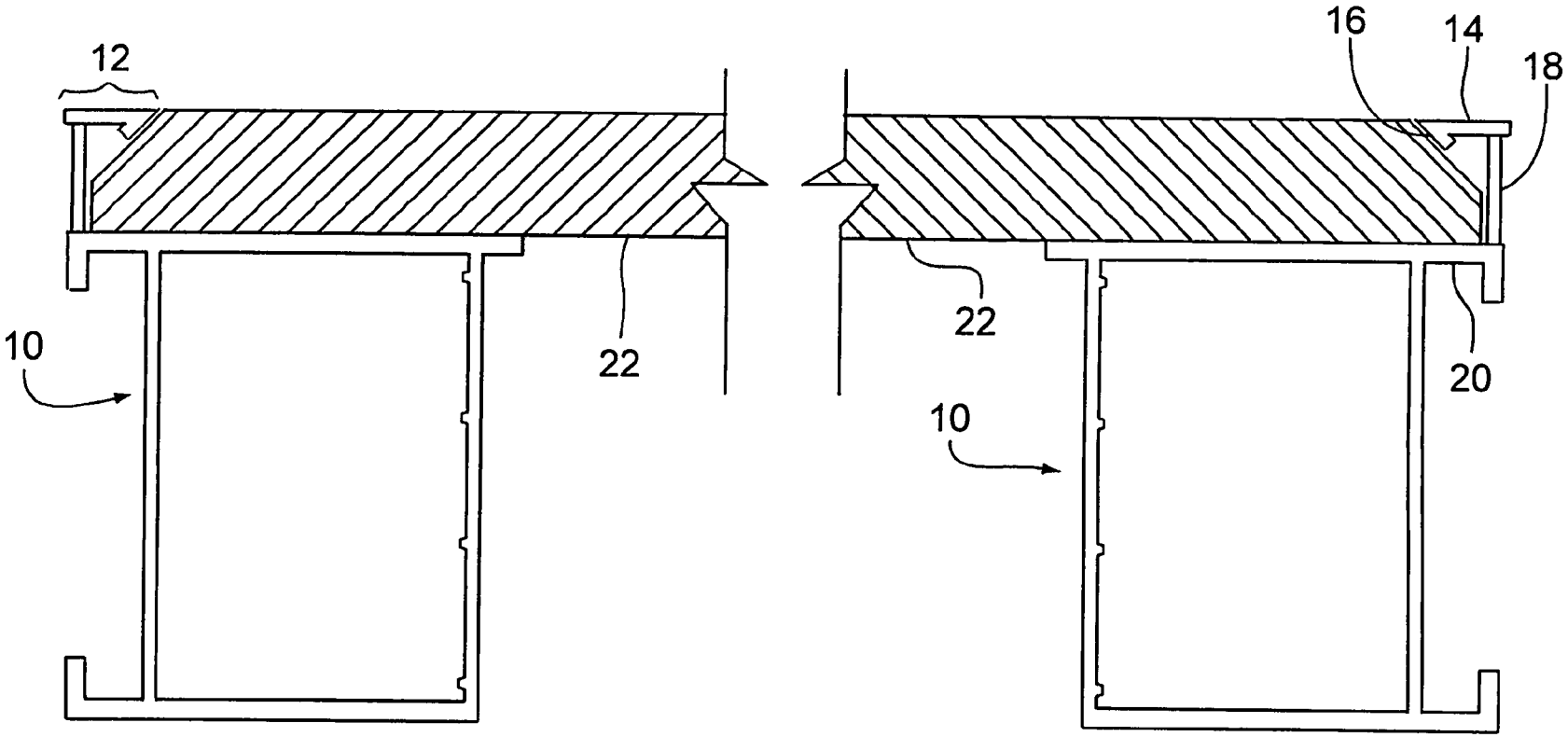
FIG. 1 is an end view showing the shaped cross section of the frame member.

FIG. 1 shows and end view of performance stage frame member 10 having shaped cross-section 12 wherein frame member 10 includes top lip 14 and chamfer 16 extending from top lip 14. Preferably, chamfer 16 is a beveled edge angularly extending inwardly and downwardly from top lip 14. Typically, top lip 14 and chamfer 16 form a 45° angle. Frame member 10 further comprises vertically extending back surface 18 with top lip 14 extending inwardly and horizontally from back surface 18. Frame member 10 further comprises bottom lip 20 extending inwardly and horizontally from the back surface.

The performance stage deck is stage deck 22 and a plurality of frame members 10 wherein the plurality of frame members capture and support the stage deck. Stage deck 22 is flush with top lip 14. No fasteners are required to connect stage deck 22 to frame members 10. Stage deck 22 has a flat top surface and the plurality of frame members 10 have a flat top surface. As a result, the flat surfaces are in a horizontal alignment with each other. A performance stage deck typically comprises a plurality of performance stage desks interlocked together to form a substantially continuous performance surface. If desired, however, fasteners may be used.

Figure 2:
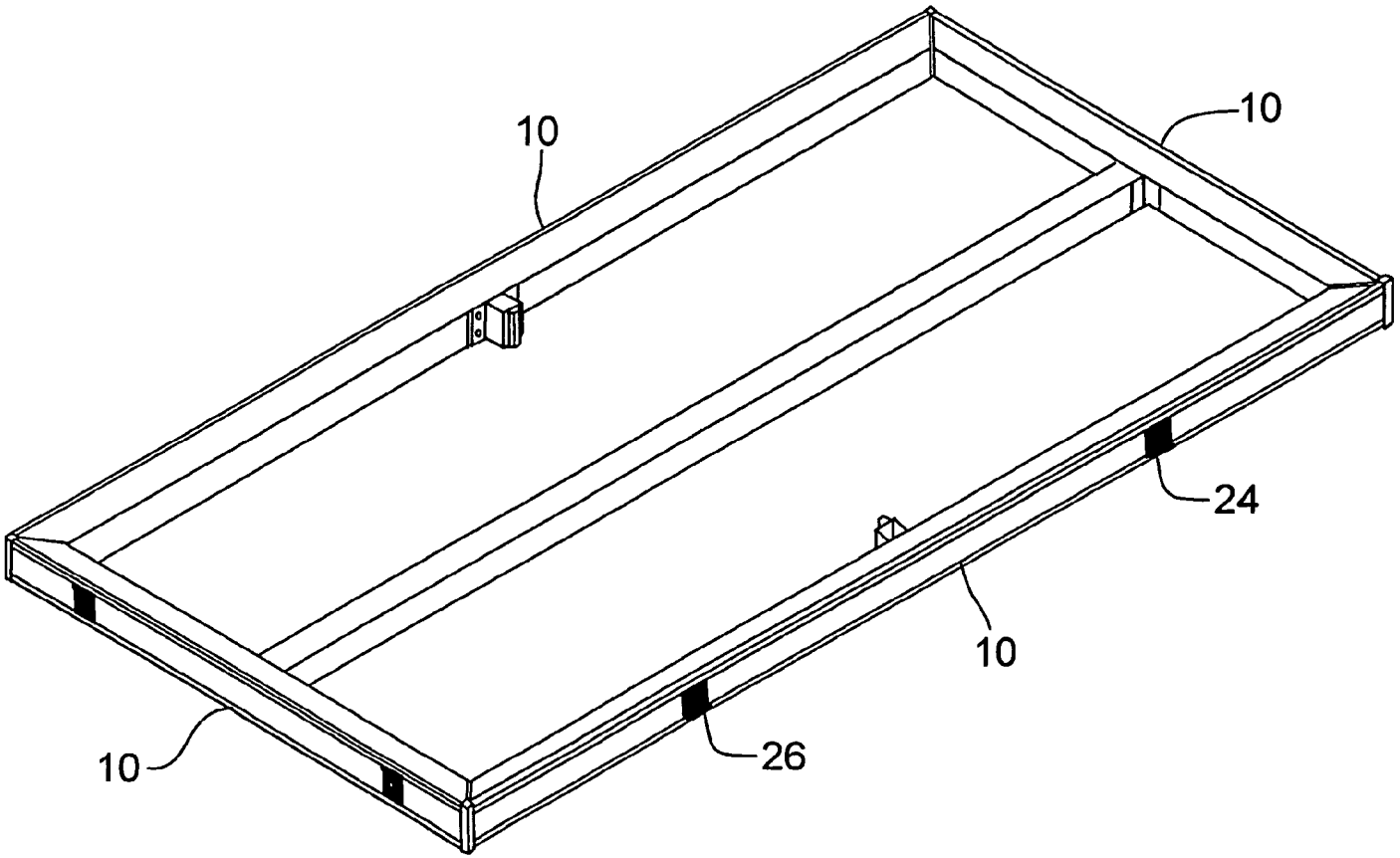
FIG. 2 is a perspective view showing assembled frame members without the stage deck.

FIG. 2 is a perspective view showing assembled frame members 10 without stage deck 22. The frame members comprise a vertically extending back surface with an outwardly facing surface and further comprise a plurality of connectors attached to the outwardly facing surface. The plurality of connectors attached to the outwardly facing surface of the frame members further comprises at least one connector having a top hook and at least one connector having a bottom hook. Adjacent frame members are aligned with complimentary connectors aligned to lock the adjacent frame members together.

Figure 3:
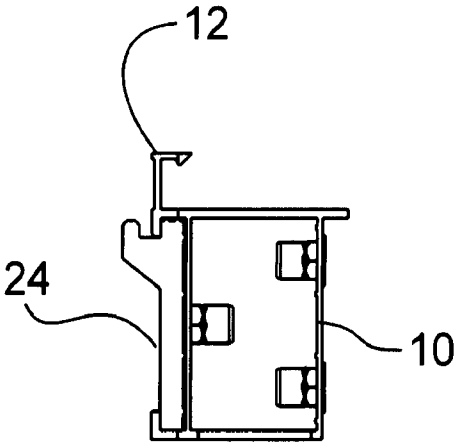
FIG. 3 is a cross-section view showing the connectors used to assemble the performance stage.
Figure 3:
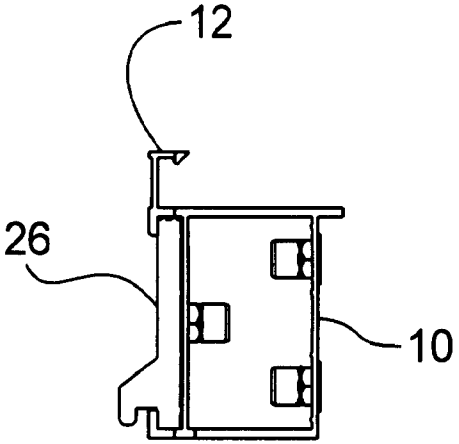

FIG. 3 is a cross-section view showing the connectors in greater detail. The complimentary connectors further comprise connector 24 having a top hook and connector 26 having a bottom hook. Connector 24 having a top hook is on one frame member and connector 26 having a bottom hook is on an adjacent frame member. The complimentary connectors are configured to keep the stage decks level with each other. The complimentary connectors are configured to guide the stage decks together to stage the stage. Further, the complimentary connectors also are configured to rigidly lock the stage decks together.

Connectors 24 and 26 are the same except that connector 24 is facing up and connector 26 is facing down. The connectors work together to transfer the load from one section to the adjacent section. They hold adjacent section level and keep them together. They are designed to prevent shifting and lifting.

Figure 4:
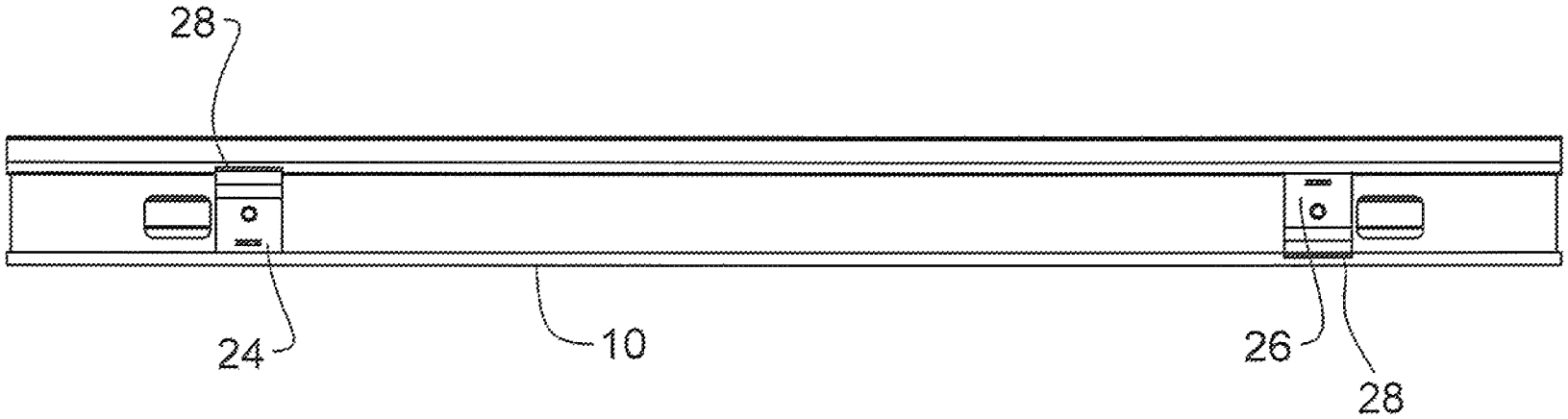
FIG. 4 is a side view of a side rail of the performance stage of this invention.

FIG. 4 is a side view of a side rail of the performance stage of this invention. FIG. 4 shows frame member 10 with connectors 24 and 26 attached thereto. Connector 26 further comprises lip 28 and connector 24 comprises lip 28.

Figure 5:
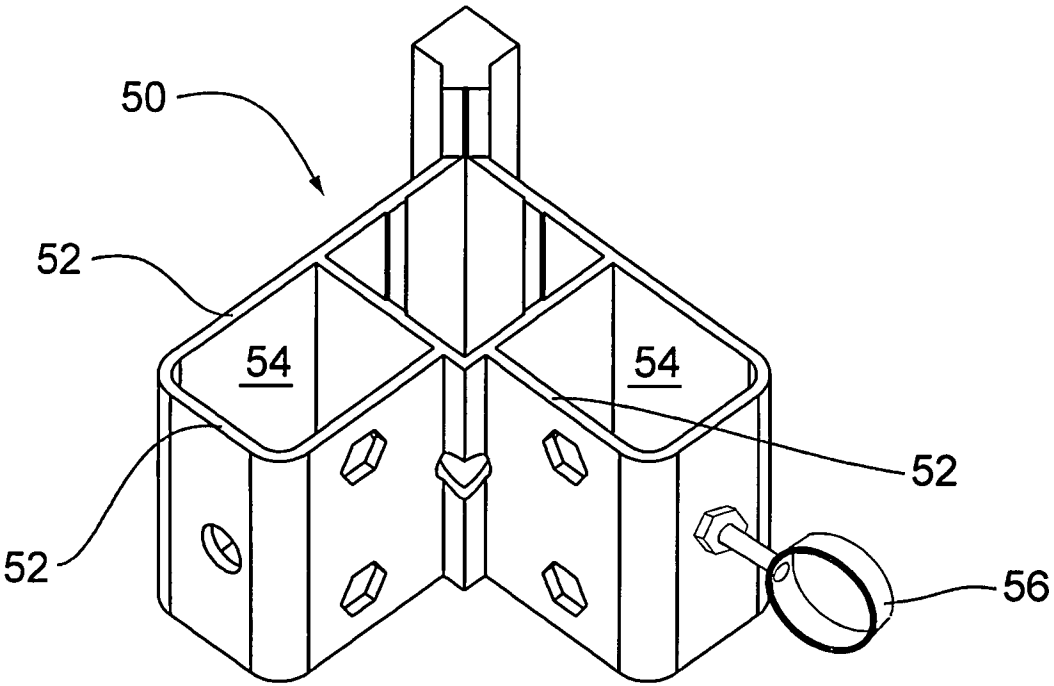
FIG. 5 is a perspective view of a corner leg socket used to assemble the performance stage.

FIG. 5 is a perspective view of a corner leg socket used to assemble the performance stage. Corner leg socket 50 is designed with side members 52 forming orifices 54. Corner leg socket 50 secures leg 80 (see FIG. 8) to frame member 10. Insert legs 80 completely into all corner leg sockets 50. Tighten leg socket clip 70 (see FIG. 7) at each corner leg socket 50. Align stage sections so that connectors 24 facing up are inside the starting area and connectors 26 facing down are outside. In another embodiment shown, plunger pin 56 secures leg 80 to socket 50. Multiple legs 80 may be used to increase the capacity of the performance stage.

Figure 6:
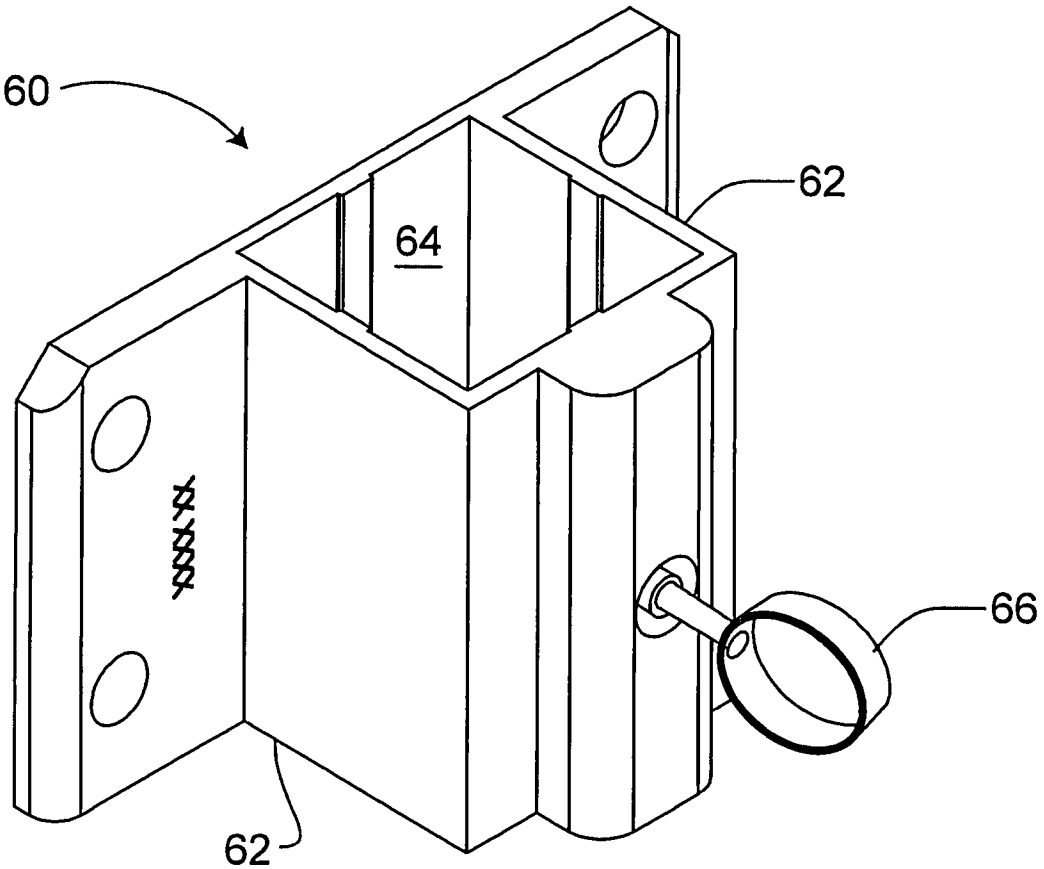
FIG. 6 is a perspective view of an intermediate leg socket used to assemble the performance stage.

FIG. 6 is a perspective view of an intermediate leg socket used to increase the capacity of the performance stage. Intermediate leg socket 60 is used to connect two frame members 10. Side members 62 form orifice 64. Multiple sockets 60 may be used to assemble a performance stage of a desired width and length. Intermediate leg socket 60 secures leg 80 (see FIG. 8) to frame member 10. Insert legs 80 completely into all intermediate leg sockets 60. Tighten leg socket clip 70 (see FIG. 7) at each intermediate leg socket 60. Align stage sections so that connectors 24 facing up are inside the starting area and connectors 26 facing down are outside. In another embodiment, plunger pin 66 secures leg 80 to socket 60.

Figure 7:
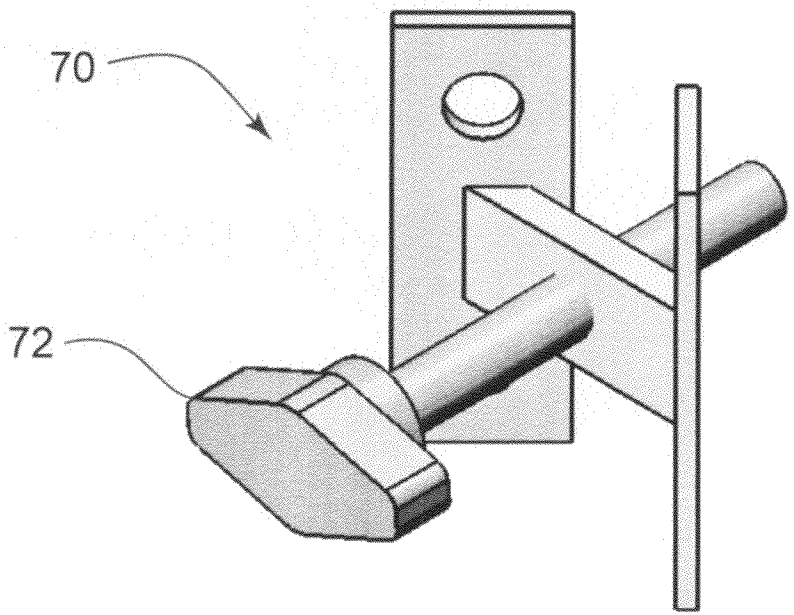
FIG. 7 is a leg socket clip assembly used to tighten assemble the performance stage leg.

FIG. 7 is a leg socket clip assembly used to tighten the performance stage leg. Leg socket clip assembly 70 is used to secure sockets 50 and 60 to legs 80. Pull and hold pin 72 in an unlocked position. Legs 80 should be fully inserted so that they touch the bottom of stage deck 22. Release pin 72 to lock legs 80 in place.

Figure 8:
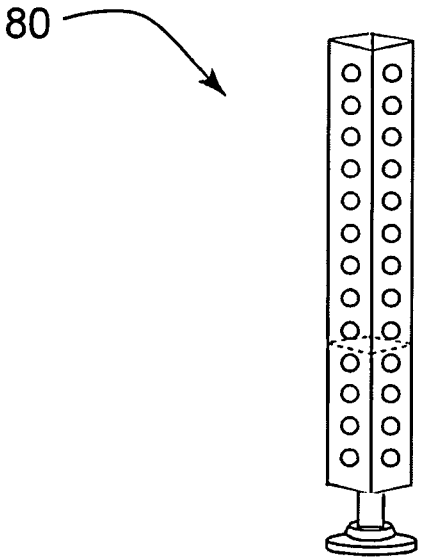
FIG. 8 is a perspective view of a leg used with the stage.

FIG. 8 is a perspective view of a leg used with the stage. Shown is leg 80. Insert legs 80 completely into sockets 50 and 60.

Figure 9:
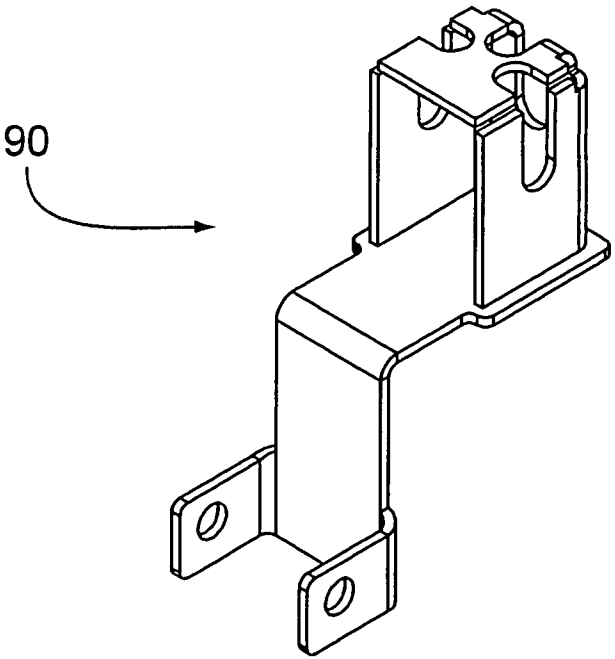
FIG. 9 is a perspective view of a stage corner support.

FIG. 9 is a perspective view of a leg bracket. Shown is leg bracket 90. In another embodiment, install leg brackets 90 as necessary. Leg brackets 90 may be installed into empty leg sockets 50 and 60 along the perimeter to prevent stage sections from sliding. Leg brackets are installed in the same way as stage legs.

Example

The stage is made up of aluminum extrusions. The top deck is captured by the side extrusion top lip. The top deck will be flush with the side rail because of the chamfer in the top lip and the deck material. See FIG. 1.

The top deck is captured in the frame work so we don't require any fasteners to connect the top deck to the frame. A steel prototype has been built.

COMPETITITVE ANALYSIS

| INVENTIVE STAGE | COMPETITORS |
|---|---|
| *1. No fasteners required to connect the stage top surface to the aluminum frame work. This gives the flexibility to use materials like Glass or Pexiglass as top surface. | 1. Required fasteners to connect the stage top to the frame. |

-continued

COMPETITITVE ANALYSIS

| INVENTIVE STAGE | COMPETITORS |
|---|---|
| 2. The capacity of the stage is 150 PSF as tested and verified. | 2. Rated capacity 125 PSF (Published) |
| *3. Built in lock that is very easy to access and operate. Saves time. See FIGS. 5 to 9. | 3. Built in lock available but not very easy to access and not easy to operate. (3A Ref for Pictures). |
| 4. No rotor lock required as the hook will hold the stage. | 4. Rotor lock is required. |
| 5. This invention also may be used for making a bleacher setup with AB Elite plastic seat. | |

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not limitative sense, the scope of the invention being defined by the appended claims.

I claim:

1. A performance stage deck assembly comprising a plurality of performance stage decks interlocked together to form a substantially continuous performance surface;

wherein each performance stage deck of the plurality of performance stage decks comprises a stage deck and a plurality of stage frame members having a shaped cross-section wherein the stage frame members each include a top lip and a chamfer extending from the top lip;

wherein the chamfer is a beveled edge angularly extending inwardly and downwardly from the top lip, wherein the top lip and chamfer form a 45° angle, wherein the plurality of stage frame members capture and support respective stage decks, wherein the stage decks are flush with the top lip, and wherein the frame members further comprise a vertically extending back surface with an outwardly facing surface and further comprise a plurality of connectors attached to the outwardly facing surface.

2. A performance stage deck assembly according to claim 1 wherein the plurality of connectors attached to the outwardly facing surface of the frame members further comprises at least one connector having a top hook and at least one connector having a bottom hook.

3. A performance stage deck assembly according to claim 2 further comprising adjacent frame members aligned with complimentary connectors aligned to lock the adjacent frame members together.

4. A performance stage deck assembly according to claim 3 wherein the complimentary connectors further comprise connectors on one frame member wherein a first connector has a top hook and a second connector has a bottom hook.

5. A performance stage deck assembly according to claim 3 wherein the complimentary connectors are configured to keep the stage decks level with each other.

6. A performance stage deck assembly according to claim 3 wherein the complimentary connectors are configured to guide the stage decks together to stage the stage.

7. A performance stage deck assembly according to claim 3 wherein the complimentary connectors are configured to rigidly lock the stage decks together.

* * * * *